US011091866B2

(12) United States Patent
Na et al.

(10) Patent No.: US 11,091,866 B2
(45) Date of Patent: Aug. 17, 2021

(54) METHOD FOR CONTROLLING LAUNDRY TREATING APPARATUS

(71) Applicant: LG Electronics Inc., Seoul (KR)

(72) Inventors: Byunghoon Na, Seoul (KR); Daewook Kwak, Seoul (KR)

(73) Assignee: LG Electronics Inc., Seoul (KR)

( * ) Notice: Subject to any disclaimer, the term of this patent is extended or adjusted under 35 U.S.C. 154(b) by 429 days.

(21) Appl. No.: 16/027,502

(22) Filed: Jul. 5, 2018

(65) Prior Publication Data

US 2019/0010651 A1 Jan. 10, 2019

(30) Foreign Application Priority Data

Jul. 5, 2017 (KR) ..... 10-2017-0085309

(51) Int. Cl.
*D06F 33/76* (2020.01)
*D06F 37/20* (2006.01)
(Continued)

(52) U.S. Cl.
CPC ..... *D06F 33/76* (2020.02); *D06F 33/00* (2013.01); *D06F 33/47* (2020.02); *D06F 37/203* (2013.01); *D06F 33/74* (2020.02); *D06F 34/16* (2020.02); *D06F 37/304* (2013.01); *D06F 39/087* (2013.01); *D06F 2105/58* (2020.02); *D06F 2202/12* (2013.01); *D06F 2204/10* (2013.01);
(Continued)

(58) Field of Classification Search
CPC ..... D06F 33/00; D06F 33/47; D06F 37/203; D06F 33/76; D06F 33/48; D06F 34/16; D06F 33/74; D06F 2105/58
See application file for complete search history.

(56) References Cited

U.S. PATENT DOCUMENTS

2009/0241605 A1* 10/2009 Moore ..... D06F 37/203 68/12.06
2015/0176184 A1* 6/2015 Jung ..... D06F 37/203 8/137

FOREIGN PATENT DOCUMENTS

EP 1882770 A1 * 1/2008 ..... D06F 37/24
JP H1024186 1/1998
KR 20170033685 A 3/2017

OTHER PUBLICATIONS

Machine translation of KR-20170033685-A, dated Mar. 2017. (Year: 2017).*

(Continued)

*Primary Examiner* — Kevin G Lee
(74) *Attorney, Agent, or Firm* — Fish & Richardson P.C.

(57) ABSTRACT

Provided is a method for controlling a laundry treating apparatus. The method includes applying power to the laundry treating apparatus and inputting an installation inspection command through an input part and performing an installation inspection for inspecting whether the laundry treating apparatus is normally installed when the installation inspection command is inputted. A control part determines whether the inputted installation inspection command is an initial installation inspection command, and wherein, when it is determined that the inputted installation inspection command is not the initial installation inspection command, the control part is configured to determine whether the previous installation and inspection has been properly performed according to an unbalance value stored in a memory, and configured to display the determined result a display part.

14 Claims, 4 Drawing Sheets

(51) Int. Cl.

| | |
|---|---|
| ***D06F 33/00*** | (2020.01) |
| ***D06F 33/47*** | (2020.01) |
| *D06F 37/30* | (2020.01) |
| *D06F 39/08* | (2006.01) |
| *D06F 34/16* | (2020.01) |
| *D06F 33/74* | (2020.01) |
| *D06F 105/58* | (2020.01) |

(52) U.S. Cl.
CPC ..... *D06F 2216/00* (2013.01); *D06F 2222/00* (2013.01)

(56) References Cited

OTHER PUBLICATIONS

Korean Office Action in Korean Appln. No. 10-2017-0085309, dated May 16, 2021, 8 pages (with English translation).

* cited by examiner

METHOD FOR CONTROLLING LAUNDRY TREATING APPARATUS

CROSS-REFERENCE TO RELATED APPLICATIONS

The present application claims the benefits of priority to Korean Patent Application No. 10-2017-0085309 filed on Jul. 5, 2017, which is herein incorporated by reference in its entirety.

BACKGROUND

The present disclosure relates to a method for controlling a laundry treating apparatus.

In general, a laundry treating apparatus is a home appliance for washing or drying laundry including clothes. For example, the laundry treating apparatus may include a washing machine and dryer.

Also, the laundry treating apparatus may be classified into a top loading type laundry treating apparatus in which a laundry loading port is provided in a top surface thereof and a front loading type laundry treating apparatus in which a laundry loading port is provided is a front surface thereof. In the top loading type laundry treating apparatus, a rotation shaft of a drum for allowing the laundry to rotate is vertically disposed. In the front loading type laundry treating apparatus, a rotation shaft of a drum extends in a horizontal direction.

When the laundry treating apparatus is installed in a washing room, various defects may occur if the installation is not properly performed. For example, when the laundry treating apparatus is installed in the washing room, there are a defect in which a water supply hose is twisted, folded, or pressed to prevent water for washing from being properly supplied, a hose connection defect such as connecting hot water hose to a cold water hose connection part, a defect in which a drain hose is twisted, folded, pressed, or bent at a height higher than that of a drain pump to prevent water for washing from being properly supplied, and a water supply/drain defect due to leakage through a hose connection portion.

Particularly, in the front loading type laundry treating apparatus, if the balance is not properly adjusted after the installation, excessive vibration and noise may occur during the rotation of the drum. The vibration and noise due to the balancing defect may be more serious in the front loading type laundry treating apparatus than in the top loading type laundry treating apparatus. Also, among the cases of service requests due to the installation defect, cases more than half of the cases are due to the noise and vibration caused by the balancing defect.

As described above, the reason for the service request cases due to the balancing defect is as follows.

In detail, when the installer installs the laundry treating apparatus to adjust the balance of the laundry treating apparatus, a weight called a balance weight which causes eccentricity inside the drum is input for correct balancing. Also, in the state in which the balance weight is input, the drum rotates at a maximum speed, and the installer adjust the balance in a direction in which steady-state vibration or continuous oscillation occurring in the state in which the drum rotates at the maximum speed is reduced.

However, some installers may adjust the balance without putting the balance weight into the drum to complete the installation of the laundry treating apparatus without the balancing.

SUMMARY

The present disclosure has been proposed to improve the above-described limitations.

Embodiments provide a method for controlling a laundry treating apparatus, which induces an installer to observe and installation guide, particularly, an installation guide for balancing, thereby minimizing an occurrence of balancing defects.

Embodiments also provide a method for controlling a laundry treating apparatus, which informs that an installer does not properly observe an installation guide for balancing when an installation inspection process is resumed at a later time even though the installation is completed without observing the installation guide to realize an accurate balancing operation again.

In one embodiment, a method for controlling a laundry treating apparatus includes: applying power to the laundry treating apparatus and inputting an installation inspection command through an input part; and performing an installation inspection for inspecting whether the laundry treating apparatus is normally installed when the installation inspection command is inputted, wherein a control part determines whether the inputted installation inspection command is an initial installation inspection command, and wherein, when it is determined that the inputted installation inspection command is not the initial installation inspection command, the control part is configured to determine whether the previous installation and inspection has been properly performed on a basis of an unbalance value stored in a memory, and configured to display the determined result on a display part.

The details of one or more embodiments are set forth in the accompanying drawings and the description below. Other features will be apparent from the description and drawings, and from the claims.

DETAILED DESCRIPTION OF THE EMBODIMENTS

Hereinafter, a method for controlling a laundry treating apparatus according to an embodiment will be described in detail with reference to the accompanying drawings.

Figure 1:
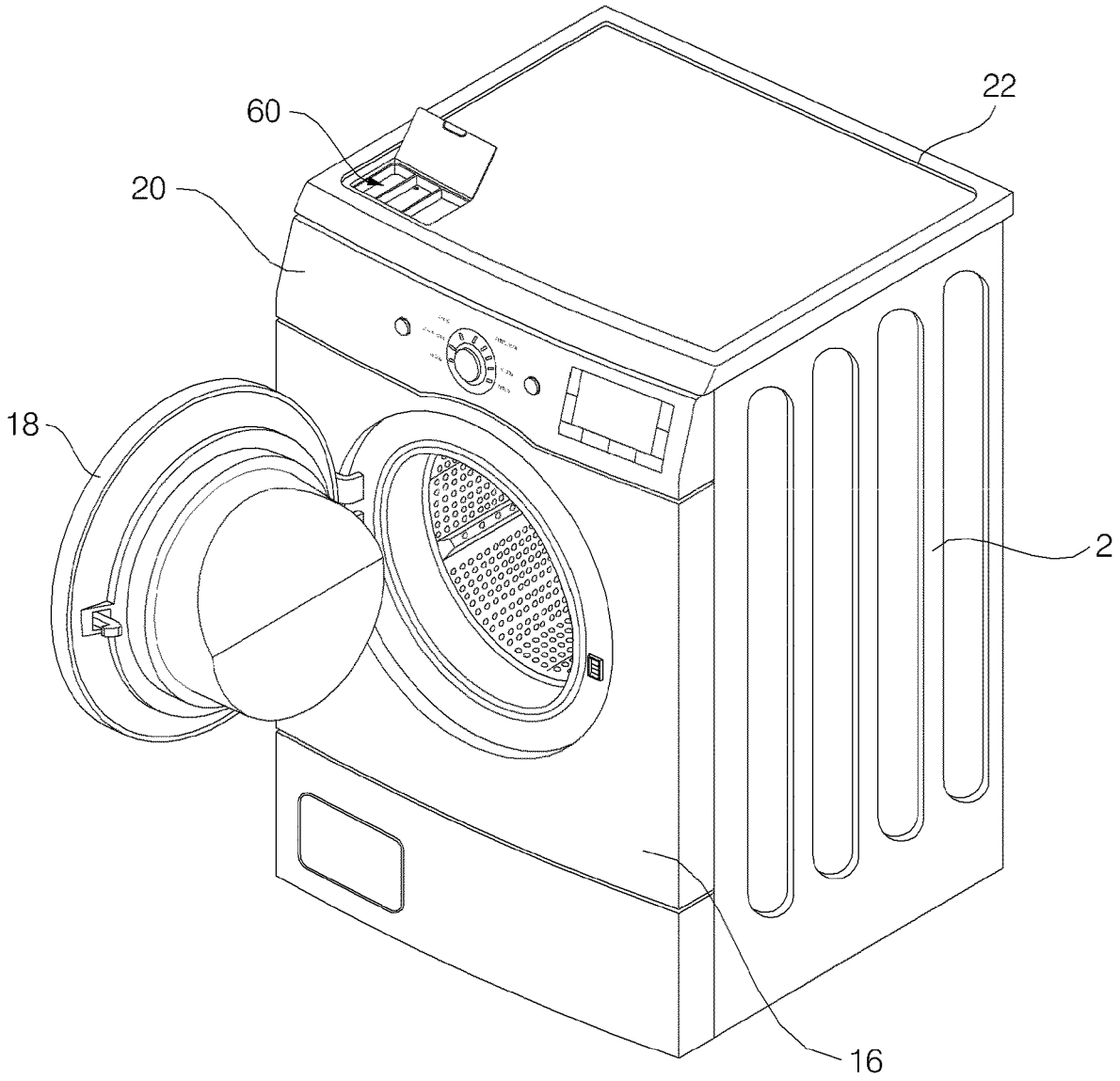
FIG. 1 is a perspective view of a laundry treating apparatus through which a control method is performed according to an embodiment.
Figure 2:
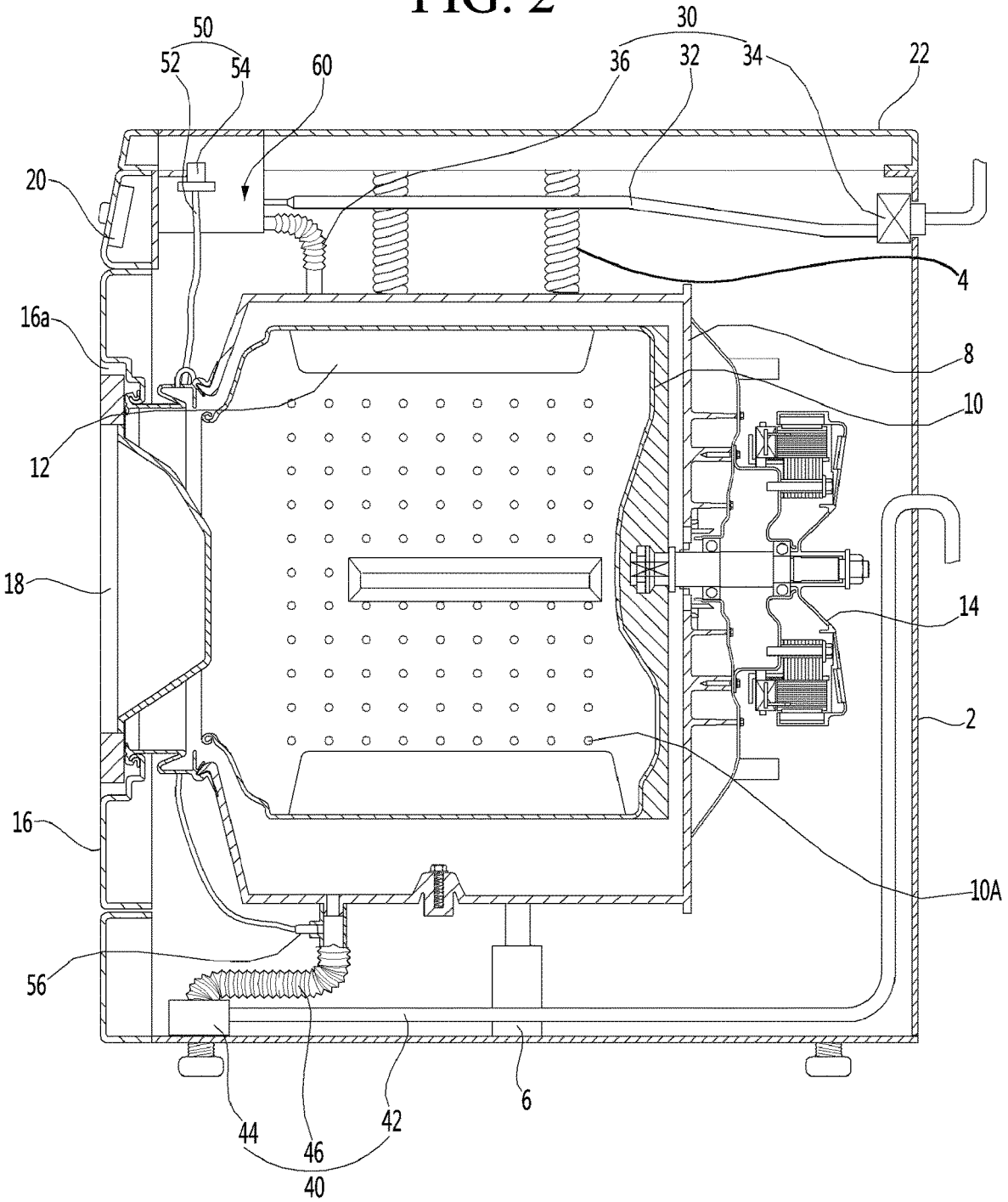
FIG. 2 is a cross-sectional view illustrating an inner structure of the laundry treating apparatus.

FIG. 1 is a perspective view of a laundry treating apparatus through which a control method is performed according to an embodiment, and FIG. 2 is a cross-sectional view illustrating an inner structure of the laundry treating apparatus.

Hereinafter, a washing machine, which is a kind of laundry treating apparatus, will be described as an example.

Referring to FIGS. 1 and 2, a laundry treating apparatus through which a control method according to an embodiment may include a cabinet 2 defining an outer appearance thereof, a tub disposed inside the cabinet 2, a drum 10 disposed inside the tub 8, a lift 12 mounted on an inner circumferential surface of the drum 10, a driving part for rotating the drum 10, a cabinet cover 16 mounted on a front surface of the cabinet 2, a door 18 coupled to the cabinet cover 16, and a control panel 20 for inputting an operation command of the laundry treating apparatus.

In detail, the tub 8 is installed to be buffered by a spring 4 and a damper 6 inside the cabinet 2 and store water for washing therein. Also, the drum 10 is disposed to be rotatable inside the tub 8 and has a plurality of through-holes 10A through which the water for washing passes. Also, the laundry is accommodated in the drum 10.

Also, the lift 12 may be installed on an inner surface of the drum 10 to lift the laundry up to a predetermined height so that the laundry drops down by gravity when the drum 10 rotates. The driving part is installed at the rear of the tub 8 to rotate the drum 10.

Also, the cabinet cover 16 is mounted at the front of the cabinet 2 and has a laundry entrance 16A at a center thereof. Also, the door 18 is rotatably installed on the cabinet cover 16 to open and close the laundry entrance 16A. Also, the control panel 20 is disposed above the cabinet cover 16 to display an operation state of the washing machine and provide an input key for inputting an operation command of the laundry treating apparatus.

Here, a top plate 22 is mounted on a top surface of the cabinet 2, and a water supply part constituted by a water supply hose 32, a water supply valve 34, and a water supply bellows 36 is provided below the top plate 22. Also, the water for washing is supplied into the tub 8 from the outside of the laundry treating apparatus through the water supply part 30.

A detergent supply part 60 is disposed between the water supply hose 32 and the water supply bellows 36 so that the detergent is supplied together with water supplied by the water supply part 30 into the tub 8. Also, a drain part 40 constituted by a drain hose 42, a drain pump 44, and a drain bellows 46 is installed below the tub 8 so that the water for washing used for washing and rinsing is drained to the outside.

The laundry treating apparatus according to an embodiment may include a water level detection part 50 that detects a water level of the water for washing supplied into the tub 8. The water level detection part 50 includes: an air hose 52 having one end connected to communicate with a lower portion of the tub 8 and filled with air; and a water level sensor 54 connected to communicate with the other end of the air hose 52. The water level sensor is configured to measure a water level within the tub 8 through a frequency variation according to a variation in pressure of the air transferred through the air hose 52.

The air hose 52 may have one end that is directly connected to the lower portion of the tub 8 or is connected to an air chamber 56 provided in one of the drain bellows 46 and the lower portion of the tub 8.

In detail, the air chamber 56 has a box-shaped structure into which air is filled. The air chamber 56 has one side fitted to communicate with the drain bellows 46 so that the water for washing is introduced and discharged; and the other side connected to the air hose 52.

Also, the water level sensor 54 measures a water level of the water for washing within the tub 8 from the variation in pressure of the air transferred by the air hose 52. That is, when the water level of the water for washing supplied to the tub is changed, the water for washing may be introduced into or discharged from the air chamber 56 to vary in pressure of the air acting on the air hose 52. The air hose 52 may transmit a water pressure to the water level sensor 54 by using air as a medium. The water level sensor 54 detects the water level of the water for washing accommodated in the tub 8 on the basis of the frequency variation that varies according to a variation in pressure.

Figure 3:
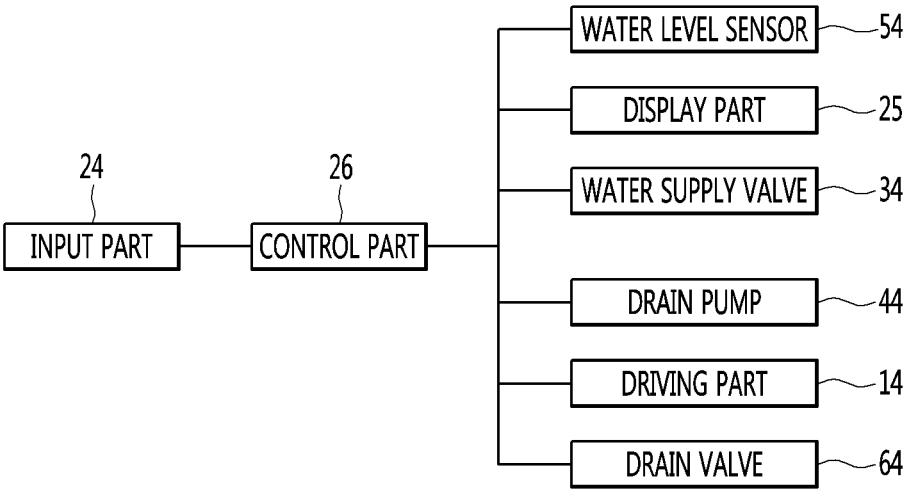
FIG. 3 is a block diagram illustrating a control configuration of the laundry treating apparatus according to an embodiment.

FIG. 3 is a block diagram illustrating a control configuration of the laundry treating apparatus according to an embodiment.

Referring to FIG. 3, the input part 24 receives various control commands with respect to an overall operation of the washing machine from a user. The input part 24 includes various operation keys provided on the control panel 20 to receive control commands including a washing course, a washing time, reservation setting, and the like through the input part 24.

The display part 25 displays state information with respect to the overall operation of the washing machine so that the user recognizes the state information. The display part 25 displays a running course, a required time or remaining time of each of running courses, commands input through the input part 24, and the like. The display part 25 represents a display such as an LCD or an LED, which is provided on the general control panel 20.

The control part 26 controls an operation of the washing machine according to the control command input through the input part 24. In more detail, the control part 26 controls operations of the display part 25, the water supply valve 34, the drain pump 44, the driving part 14, the drain valve 64, and the like and also controls an operation of the water supply valve 34 according to a detected value of the water level sensor 54.

Figure 4:
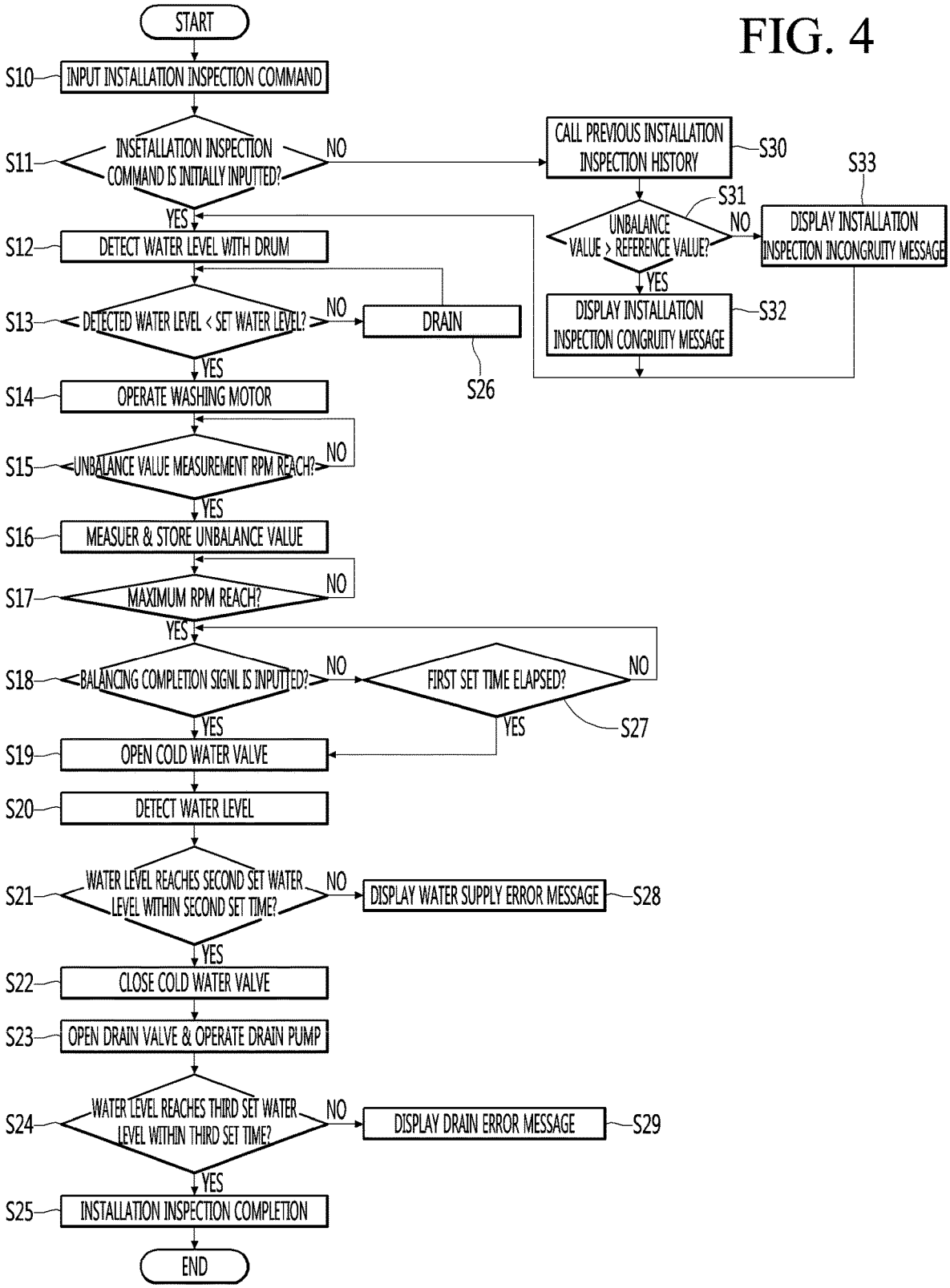
FIG. 4 is a flowchart illustrating a method for controlling a laundry treating apparatus according to an embodiment.

FIG. 4 is a flowchart illustrating a method for controlling a laundry treating apparatus according to an embodiment.

Referring to FIG. 4, a method for controlling a laundry treating apparatus according to an embodiment may be a method for automatically confirming whether installation is normally performed before an actual operation after the laundry treating apparatus is installed. The method for controlling the laundry treating apparatus may be defined as an 'installation inspection mode'.

In detail, an installer installs the laundry treating apparatus at an installation site specified by a purchaser (a user) and connects a power cord so that power is applied. Thus, the power is applied to the input part 24 of the laundry treating apparatus so that the operation command is capable of being inputted. In this state, the installer inputs an installation inspection command (S10).

In detail, the installation inspection command represents an instruction to start an installation inspection mode. A button for installation inspection mode may be separately provided on the input part 24, and two or more among a plurality of input parts, for different operation commands, may be operated simultaneously or sequentially with a time difference so that the installation inspection mode is performed. The installation inspection mode is generally very low in usage frequency after the laundry treating apparatus is initially installed. Thus, it may be preferable to use existing command input buttons rather than installing a separate or independent input button used only for the installation inspection mode.

Also, when the installation inspection command is inputted, the control part 26 determines whether the inputted installation inspection command is an initial installation inspection command (S11). When it is determined that the inputted installation inspection command is the initial installation inspection command, the control part 26 detects a water level within a drum through a water level sensor 54

(S12). The change of the water level may be recognized by the control part 26 as a frequency variation value as described above.

Also, it is determined whether the detected water level is less than a first set water level (S13), and the first set water level may represent a water level in which the water for washing does not exist, i.e., a water level corresponding to complete drain.

If it is determined that the detected water level is equal to or greater than the first set water level, the drain pump 44 may be driven to drain water remaining in the drum (S26). Here, the reason for detecting the water level within the drum first in installation conditions of a product is for improving accuracy of installation inspection by considering the likelihood that the laundry treating apparatus may be delivered to the purchaser in a state where the water used to clean the drum during an inspection process of a manufactured product has not been completely drained after the inspection process.

If the water level is not reduced because the drain is not properly performed in this state, there is a problem in drainage, and thus, a drain error message may be displayed immediately. Also, when the installer solves the drain defect and presses a specific button, the installation inspection may be continued. That is, the process of detecting the water level within the drum may be performed again. Also, an input of a continuation command of the installation inspection through a specific button is regarded as being different from the input of the initial installation inspection command. That is, after the problem is solved, the installation inspection continuation process is recognized by the control part as a part of the installation inspection process.

When it is determined that the detected water level is less than the first set water level, the control part 26 operates a washing motor (S14). Also, it is determined whether a rotation speed (rpm) of the washing motor reaches a speed for measuring an unbalance value (or an eccentric value) of the drum (S15).

In detail, the rotation speed of the washing motor for measuring the unbalance value of the drum may be about 108 rpm, but is not limited thereto. Also, when the rotation speed of the washing motor reaches an unbalance value measurement speed, the control part 26 measures the unbalance value of the drum and stores the measured unbalance value in a memory (S16).

Also, it is determined whether the speed of the washing motor reaches the maximum speed (S17), and the washing motor is maintained at the maximum speed for a set time. In this state, the installer performs a balancing of the laundry treating apparatus. In the state where the speed of the washing motor reaches the maximum speed, a steady-state vibration having a low vibration width and a high frequency is generated in the cabinet of the laundry treating apparatus. In this state, the installer minimizes the vibration width of the steady-state vibration through the balancing of the laundry treating apparatus.

Also, the installer inputs a balancing completion command when the balancing is completed. Thus, the control part 26 of the laundry treating apparatus determines whether a balancing completion signal is inputted within a first set time (S18). If the balancing completion signal is not inputted until the first set time elapses (S30), the process automatically moves on to the next step.

In detail, when the balancing completion signal is inputted within the first set time, or the first set time elapses without inputting the balancing completion signal, a cold water valve opening operation is performed (S19), and a water level of the cold water supplied into the drum is detected (S20). Here, a water temperature may be detected together with the water level of the cold water. The reason of performing the water temperature detection is for determining whether the hot water hose is incorrectly connected to the cold water supply port on which the cold water valve is mounted. That is, it is determined that the detected water temperature is higher than that of the cold water, i.e., the hot water, a hose connection error message may be displayed.

It is determined whether the water level within the drum reaches a second set water level before a second set time elapses from a time point at which the cold water valve is opened (S21), and if it is determined that the water level reaches the second water level within the second set time, the cold water valve is closed (S22). On the other hand, when it is determined that the water level reaches the second water level within the second set time, a water supply error message may be displayed on the display part 25 by using a charter or sound. The cause of the water supply error may be due to inability to supply water when the water supply hose is bent or pressed. For other reasons, a water pressure at the installation site may be low to cause a water supply error. An error generated when the hot water hose is incorrectly connected to the cold water supply port may be regarded as a kind of water supply error, and thus, the same type of an error message may be displayed.

When the inspection with respect to whether the water supply is normally performed, and/or whether the cold water is normally supplied is completed, the drain valve may be opened to operate the drain pump so as to inspect whether the drain is smoothly and normally performed (S23). Also, it is determined whether the water level is lowered to a third water level within a third set time after the drain valve is opened, and the drain pump is operated (S24). If it is determined that the water level is lowered to the third water level within the third set time, the installation inspection is completed (S25), and then, the installation inspection process is ended. If the water level is not lowered to the third water level within the third set time, a drain error message may be displayed (S32). A method for displaying the drain error message may be the same as that for displaying the water supply error message. The case in which the drain error occurs may include a case in which an outlet end of the drain hose or a bent portion of the drain hose is disposed at a position higher than the water level within the drum, in addition to the case in which the drain hose is bent to be folded or pressed.

If the control part determines that the input of the installation inspection command is not an input of an initial installation inspection command in the process (S11) of determining whether the input of the installation inspection command is the input of the initial installation inspection command, the control part 26 calls the stored inspection history from the memory in the previous installation inspection process (S30). In detail, the control part 26 calls the unbalance value measured and stored in the unbalance value measurement process of the previous installation inspection and determines whether the called unbalance value exceeds a reference value (S31).

When the called unbalance value exceeds the reference value, it is regarded that the previous installation inspection is normally performed according to an installation manual, and thus, a message indicating that the installation inspection is appropriate is displayed (S32). On the other hand, when the called unbalance value less than the reference value, it is regarded that the previous installation inspection is not normally performed according to the installation manual, and thus, a message indicating that the installation inspection is inappropriate is displayed (S33).

Also, the installation inspection congruity or incongruity message is displayed for a set time, and then, the installation inspection processes (S12 to S25) are automatically performed. Alternatively, the installation inspection process may be automatically performed after the set time elapses only when the installation inspection congruity message is displayed. When the installation inspection incongruity message is displayed, the incongruity message may be displayed until the installation inspector inputs a separate operation command through the input part.

In detail, according to the manual in the initial product installation process, the installer may insert a balance weight having a weight of 300 g to 500 g into the drum so as to perform the balancing and rotate the drum to full speed to perform the balancing operation so that the balancing is increases in accuracy. However, the installer may perform the balancing operation without loading the balance weight so as to finish the installation operation quickly.

In the state in which the balance weight is inputted, the difference between the case of rotating the drum and the case of not rotating the drum indicates a difference in unbalance value. Thus, while the laundry treating apparatus is installed and used, when a problem arises in the balance of the laundry treating apparatus, and thus the installation inspection mode is performed again, whether the previous installer has followed the installation manual correctly may be confirmed based on the unbalance value. Here, a reference unbalance value represents an unbalance value detected in the state in which the weight balance is inputted.

As described above, since it is determined whether the installer has properly followed the manual for the balancing from the unbalance value initially detected by installing the laundry treating apparatus at the installation site, it may have the effect of forcing the installer to follow the installation manual correctly during the initial installation.

The method for controlling the laundry treating apparatus including the above-described constituents according to the embodiment has following effects.

First, since the installation inspection process for the laundry treating apparatus is automatically performed, the installation defects may be displayed to be informed to the installer.

Second, in the case in which the installer performs the balancing process without inputting the weight balance into the drum, when the installation inspection mode is executed again later by another installer, it may inform that the balancing process is performed without the weight balance to another installer so that the balancing process is performed again along the installation guideline.

Third, since it informs that the balancing process is not performed along the fixed guideline when the installation inspection mode is performed again at the later time, the attention to installer who initially performs the installation, and the same mistake may be prevented from being repeated.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a laundry treating apparatus including a drum, the method comprising:

applying power to the laundry treating apparatus and inputting an installation inspection command through an input part;

performing an installation inspection for inspecting whether the laundry treating apparatus is normally installed when the installation inspection command is inputted;

determining, by a control part, whether the inputted installation inspection command is an initial installation inspection command;

based on determining that the inputted installation inspection command is not the initial installation inspection command, determining, by the control part, whether a previous installation inspection has been properly performed on a basis of an unbalance value stored in a memory;

based on the unbalance value stored in the memory being greater than or equal to a reference value, displaying, on a display part, a congruity message notifying that the previous installation inspection has been properly performed, wherein the reference value is an unbalance value detected when the drum rotates in a state where a balance weight is inputted into the drum; and based on the unbalance value being less than the reference value, displaying, on the display part, an incongruity message notifying that the previous installation inspection has not been properly performed.

2. The method according to claim 1, wherein, after the congruity or incongruity message is displayed for a set time, the installation inspection is automatically performed.

3. The method according to claim 1, wherein, when the congruity message is displayed, and a set time elapses, the installation inspection is automatically performed.

4. The method according to claim 1, wherein, when the installation inspection command is inputted, a current water level within the drum is detected, and when the detected water level is less than a first set water level, a washing motor is operated.

5. The method according to claim 4, wherein the washing motor is accelerated to an rpm for measuring the unbalance value of the drum, the unbalance value of the drum is measured in the state where the washing motor rotates at the rpm for measuring the unbalance value of the drum, and wherein the measured unbalance value is stored in the memory.

6. The method according to claim 5, wherein the washing motor is accelerated to an rpm for balancing the laundry treating apparatus, and wherein the rpm for balancing the laundry treating apparatus is greater than the rpm for measuring the unbalance value of the drum.

7. The method according to claim 6, wherein the washing motor rotates at the rpm for balancing the laundry treating apparatus for a first set time, and wherein, when a balancing completion signal is inputted within the first set time, or the first set time elapses without the balancing completion signal being inputted, a next installation inspection process is performed.

8. The method according to claim 7, wherein the next installation inspection process comprises:

a first determination process in which water supply valve is opened to determine whether water supply is normally performed or not; and a second determination process in which a drain valve is opened while closing a cold water valve, and a drain pump is operated to determine whether drain is normally performed or not.

9. The method according to claim 8, wherein the first determination process comprises at least one of:

a water supply error inspection process of detecting a water level of water for washing which is supplied by opening the cold water valve; and a water supply hose connection inspection process of detecting a temperature of the water for washing which is supplied by opening the cold water valve.

10. The method according to claim 9, wherein, in the water supply error inspection process, whether the water level reaches a second set water level within a second set time after the cold water valve is opened is determined, and wherein, when the water level does not reach the second set water level within the second set time, a water supply error signal is displayed on the display part.

11. The method according to claim 9, wherein, in the water supply hose connection inspection process, when a temperature of the supplied water for washing is higher than a set temperature, the control part determines that a hot water hose is connected to a cold water supply port, and a water supply hose connection error signal is displayed on the display part.

12. The method according to claim 8, wherein the second determination process comprises a drain error inspection process of determining whether a drain water level reaches a third set water level within a third set time, and wherein, when the drain water level reaches the third set water level within the third set time, the installation inspection is completed.

13. The method according to claim 12, wherein, when the drain water level does not reach the third set water level within the third set time, a drain error signal is displayed on the display part.

14. The method according to claim 1, further comprising:

determining, by the control part, whether the unbalance value stored in the memory exceeds the reference value.

* * * * *